US011173727B2

(12) United States Patent
Toyama et al.

(10) Patent No.: US 11,173,727 B2
(45) Date of Patent: Nov. 16, 2021

(54) PRINTING APPARATUS AND PRINTING METHOD

(71) Applicant: SEIKO EPSON CORPORATION, Tokyo (JP)

(72) Inventors: Hiroshi Toyama, Shiojiri (JP); Satoru Katagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/892,407

(22) Filed: Jun. 4, 2020

(65) Prior Publication Data

US 2020/0384780 A1 Dec. 10, 2020

(30) Foreign Application Priority Data

Jun. 7, 2019 (JP) ..... JP2019-106903

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/00242
See application file for complete search history.

(56) References Cited

U.S. PATENT DOCUMENTS

2012/0189370 A1* 7/2012 Barker ..... B41J 11/0021 400/611
2018/0229512 A1 8/2018 Katagami

FOREIGN PATENT DOCUMENTS

JP 2018-130901 A 8/2018

* cited by examiner

*Primary Examiner* — Bradley W Thies
(74) *Attorney, Agent, or Firm* — Workman Nydegger

(57) ABSTRACT

A printing apparatus includes a printing portion that performs printing on a printing medium, a heating portion that heats the printing medium, which is performed downstream of the printing portion in transport of the printing medium, and a controller. The heating portion is disposed in a position facing a back surface, on which the printing is performed. The controller executes first control for putting the heating portion in a first state in which the heating portion is in contact with the back surface during a transport stop period, in which transport of the printing medium is stopped, and executes second control for putting the heating portion in a second state in which the heating portion contacts the back surface at a lower degree than in the first state during a transport period, in which the transport of the printing medium is performed.

5 Claims, 4 Drawing Sheets

PRINTING APPARATUS AND PRINTING METHOD

The present application is based on, and claims priority from JP Application Serial Number 2019-106903, filed Jun. 7, 2019, the disclosure of which is hereby incorporated by reference herein in its entirety.

BACKGROUND

1. Technical Field

The present disclosure relates to a printing apparatus and a printing method.

2. Related Art

A printing apparatus is disclosed that prints an image by repeatedly intermittently transporting and stopping a long medium wound in a roll shape, over an intermittent transport distance, and ejecting ink from a recording head onto a portion of the medium that is stopped on a platen (see JP-A-2018-130901).

According to JP-A-2018-130901, a drying portion for drying the medium after printing is disposed downstream of the platen in a transport direction, and, in the drying portion, the medium is dried by heating the medium using hot air inside a housing of the drying portion.

In such a method for drying the medium using the hot air, as in JP-A-2018-130901, there is a tendency for a large amount of time to be required to sufficiently dry the medium. Therefore, there is a demand for more efficient drying of the medium. Further, with respect to drying the medium, there is a demand to suppress drying unevenness and uniformly dry the medium, and to smoothly transport the medium before and after drying.

SUMMARY

A printing apparatus includes a printing portion configured to perform printing on a printing medium by discharging ink onto the printing medium; a heating portion configured to heat the printed printing medium, which is performed downstream of the printing portion in transport of the printing medium; and a controller, wherein the heating portion is disposed in a position facing a back surface, which is an opposite surface of the printing medium from a printing surface, on which the printing is performed, and the controller executes first control for putting the heating portion in a first state in which the heating portion is in contact with the back surface during a stop period, in which transport of the printing medium is stopped, and executes second control for putting the heating portion in a second state in which the heating portion contacts the back surface at a lower degree than in the first state during a transport period, in which the transport of the printing medium is performed.

DESCRIPTION OF EXEMPLARY EMBODIMENTS

Embodiments of the present disclosure will be described below with reference to the accompanying drawings. Each of the drawings is merely illustrative for describing the present embodiment. Since each of the drawings is illustrative, shapes and ratios may not be precise, some drawings may not match each other, and some parts may be omitted.

1. Schematic Configuration of Printing Apparatus

Figure 1:
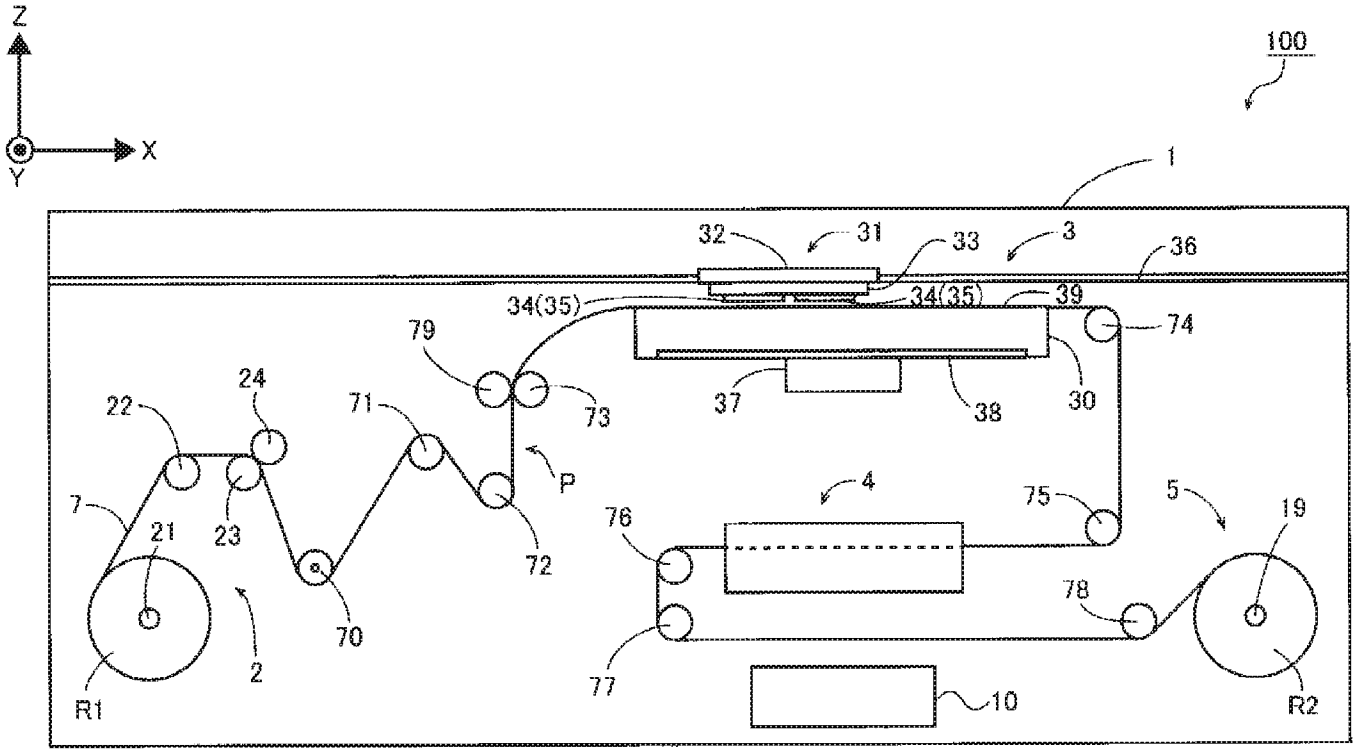
FIG. 1 is a schematic view illustrating a configuration of a printing apparatus.

FIG. 1 is a diagram illustrating a configuration of a printing apparatus 100. The printing apparatus 100 executes a printing method. The printing apparatus 100 uses an ink jet method to print an image on a printing medium 7 while feeding the long printing medium 7 wound in a roll shape. The printing apparatus 100 includes a main body casing 1 as a housing. Inside the main body casing 1 are disposed a controller 10 that controls each portion of the printing apparatus 100, a feeding portion 2 that feeds the printing medium 7 from a roll body R1 wound in a roll shape, a printing portion 3 that performs printing by discharging ink onto the printing medium 7 fed by the feeding portion 2, a drying portion 4 that dries the printing medium 7 onto which the ink has adhered, and a winding portion 5 that takes up the dried printing medium 7 as a roll R2. Discharging is also referred to as ejecting.

In the following description, a longitudinal direction of the main body casing 1 is an X direction, a lateral direction of the main body casing 1 is a Y direction, and an upward direction of the main body casing 1 is a Z direction. In the example of FIG. 1, the direction from left to right is the X direction, and the direction from the back (rearward) to the front (forward) of the paper in FIG. 1 is the Y direction. The printing portion 3 includes a platen 30 and a printing unit 31. The platen 30 supports a part of the printing medium 7 from below, on a support face 39 that faces upward. It may be understood that the support face 39 is parallel to the X direction and the Y direction. The printing unit 31 performs the printing on the printing medium 7 supported on the platen 30.

In an example illustrated in FIG. 1, the feeding portion 2, the drying portion 4, and the winding portion 5 are disposed to be lower than the printing portion 3. On a transport path P of the printing medium 7, the feeding portion 2 is positioned upstream of the printing portion 3, the drying portion 4, and the winding portion 5, and the winding portion 5 is positioned downstream of the printing portion 3 and the drying portion 4. In the following description, upstream and downstream on the transport path P will be simply described as upstream and downstream. The printing portion 3 is positioned upstream of the drying portion 4.

The feeding portion 2 includes a freely rotatable holding shaft 21 that holds the roll body R1 around which the printing medium 7 is wound. Further, the feeding portion 2 includes a roller 22 and a feed roller 23. The printing medium 7 unwound from the roll body R1 held by the holding shaft 21 is stretched over the roller 22 and the feed roller 23 in this order. The feed roller 23 is a driving roller that rotates as a result of a driving force from a motor (not illustrated). The feed roller 23 feeds the printing medium 7 by rotating in a state in which the printing medium 7 pulled out from the holding shaft 21 is wound on the feed roller 23. In order to be able to reliably feed out the printing medium 7 using the feed roller 23, the feeding portion 2 is provided with a pressing roller 24 that is urged toward the feed roller 23, and the pressing roller 24 presses the feed roller 23 with the printing medium 7 interposed therebetween.

The winding portion 5 is provided with a freely rotatable winding shaft 19. The winding shaft 19 supports the roll body R2 around which the printing medium 7 is taken up. The printing medium 7 fed out by the feeding portion 2 is transported along the transport path P by being guided by a plurality of rollers 70 to 79, sequentially passes through the printing portion 3 and the drying portion 4, and is directed toward the winding portion 5.

Specifically, the printing medium 7 fed out by the feed roller 23 is stretched over the movable roller 70 and the rollers 71 and 72, in this order. As a result of its own weight, the movable roller 70 comes into contact, from above, with the printing medium 7 stretched between the feed roller 23 and the roller 71, and applies tension to the printing medium 7. The transport roller 73 is disposed downstream of the roller 72 and upstream of the platen 30. The transport roller 73 is a driving roller that rotates as a result of a driving force from a motor (not illustrated). The transport roller 73 transports the printing medium 7 onto the platen 30 by rotating in a state in which the printing medium 7 transported from the rollers 71 and 72 is wound on the transport roller 73. In order to ensure that the transport of the printing medium 7 by the transport roller 73 is reliably executed, the pressing roller 79 that is urged toward the transport roller 73 is provided, and the pressing roller 79 presses the transport roller 73 with the printing medium 7 interposed therebetween.

The roller 74 is disposed downstream of the platen 30. The transport roller 73 and the roller 74 are disposed along the X direction such that the platen 30 is interposed therebetween. The printing medium 7 wound on the transport roller 73 moves in the X direction while coming into contact with the support face 39 of the platen 30 until the printing medium 7 reaches the roller 74, and the printing medium 7 wound onto the roller 74 is guided downward. As described above, when the printing medium 7 is transported downstream, the printing medium 7 is transported in the X direction on the support face 39.

Below the roller 74, the rollers 75 and 76 are disposed along the X direction. The printing medium 7 wound on the rollers 75 and 76 is guided between the roller 75 and the roller 76 in parallel with the X direction. Further, the drying portion 4 is disposed between the rollers 75 and 76. Thus, the printing medium 7 wound on the roller 75 passes through the interior of the drying portion 4 until the printing medium 7 reaches the roller 76. The rollers 77 and 78 are disposed downstream of the roller 76, and the printing medium 7 wound on the rollers 77 and 78 is taken up by the winding portion 5.

In this manner, in real terms, the transport path P of the printing medium 7 is formed by the above-described rollers and the support face 39 of the platen 30 disposed between the holding shaft 21 and the winding shaft 19. Each of the above-described rollers, and the motors or the like for driving each of the rollers may be referred to as a transport portion for transporting the printing medium 7. Note that the number and arrangement of the rollers configuring the transport portion is not limited to the mode illustrated in FIG. 1.

The printing unit 31 is provided with a carriage 32, a flat plate shaped support plate 33 attached to a lower surface of the carriage 32, and a plurality of print heads 34 attached to a lower surface of the support plate 33. The print head 34 includes a plurality of nozzles 35, and discharges ink supplied from an ink cartridge (not illustrated) from each of the nozzles 35 to print an image on the printing medium 7.

The carriage 32 moves integrally with the support plate 33 and the print heads 34. Specifically, the printing portion 3 is provided with a first guide rail 36 extending in the X direction, and when the carriage 32 receives a driving force from a motor (not illustrated), the carriage 32 moves in parallel to the X direction along the first guide rail 36. Further, a second guide rail (not illustrated) extending in the Y direction is provided inside the printing portion 3, and, when the carriage 32 receives a driving force from a motor (not illustrated), the carriage 32 moves in parallel to the Y direction along the second guide rail.

As a result of the carriage 32 moving in two dimensions with respect to the section of the printing medium 7 that stops on the support face 39 of the platen 30, the printing of the image on the printing medium 7 is performed. A range of the printing medium 7 supported by the support face 39 serves as a printing region for one frame by the printing unit 31, and the printing unit 31 performs printing of one frame on the printing region based on print data for the one frame. Then, the transport portion transports the printing medium 7 downstream, taking a predetermined distance in the X direction (hereinafter referred to as an intermittent transport distance) as a unit of transport for one cycle. As described above, according to the printing apparatus 100, a transport step of performing intermittent transport in which the transport of the printing medium 7 over the intermittent transport distance and the stopping of the transport of the printing medium 7 are repeated, and a printing step in which the printing is performed on the printing medium 7 by the printing portion 3 during a transport stop period in which the transport of the printing medium 7 is stopped, are realized. Using the printing unit 31, the printing portion 3 performs the one frame of printing on the section of the printing medium 7 supported by the support face 39 during the transport stop period.

In order to keep the printing medium 7 stopped on the support face 39 flat, the platen 30 is provided with a suction mechanism for the printing medium 7 stopped on the support face 39. Specifically, a plurality of suction holes (not illustrated) are open in the support face 39, and a suction portion 37 is attached to a lower surface of the platen 30. Then, when the suction portion 37 operates in the transport stop period when the printing medium 7 is stopped, a negative pressure is generated in the suction holes of the support face 39, and the printing medium 7 adheres to the support face 39. When the printing unit 31 finishes the one frame of printing, the suction portion 37 stops the suction of the printing medium 7 and allows subsequent transport of the printing medium 7.

A heater 38 is attached to the lower surface of the platen 30. The platen 30 is heated by the heater 38. The printing medium 7 receives heat from the platen 30 concurrently with receiving the discharge of the ink from the print heads 34. In this way, the ink that has landed on the printing medium 7 is dried, and bleed-through between the ink is suppressed, for example. In the example illustrated in FIG. 1, heat generated by the heater 38 is transferred to the printing medium 7 via the platen 30. The drying of the printing medium 7 by the heat of the heater 38 is referred to as primary drying. In contrast, the drying of the printing medium 7 by the drying portion 4 is referred to as secondary drying. However, in the present embodiment, the primary drying using the platen 30 is not an essential process.

The printing medium 7 that has been printed by the printing portion 3 is transported downstream by the intermittent transport, and is eventually transported into the drying portion 4. A section of the printing medium 7 that is loaded into and stopped in the drying portion 4 is heated by a "heating portion" included in the drying portion 4 (a heating step), and the ink that has landed on the printing medium 7 is further dried. The drying portion 4 is also referred to as a drying oven. The drying portion 4 including the heating portion will be described in detail later.

The printing medium 7 is, for example, paper. Alternatively, the printing medium 7 may be configured by a printing member on which ink is discharged and printing is carried out, and a support member that is a base paper removably adhered to the printing member. The printing member is configured, for example, by a resin film such as cellophane, stretched polypropylene, polyethylene terephthalate, stretched polystyrene, polyvinyl chloride, and the like. The support member is configured, for example, by high quality paper, kraft paper, copy paper, glassine paper, parchment paper, rayon paper, coated paper, synthetic paper, and the like.

The controller 10 includes a processor such as CPU and a memory. In the controller 10, a processor follows a program stored in a memory in order to control the operation of each of the portions, such as the transport portion, the feeding portion 2, the printing portion 3, the drying portion 4, and the winding portion 5.

Note that, for a more detailed description of the printing apparatus 100, the JP-A-2018-130901 may be referred to as appropriate.

2. Description of Drying Portion

2-1. First Example

Figure 2:
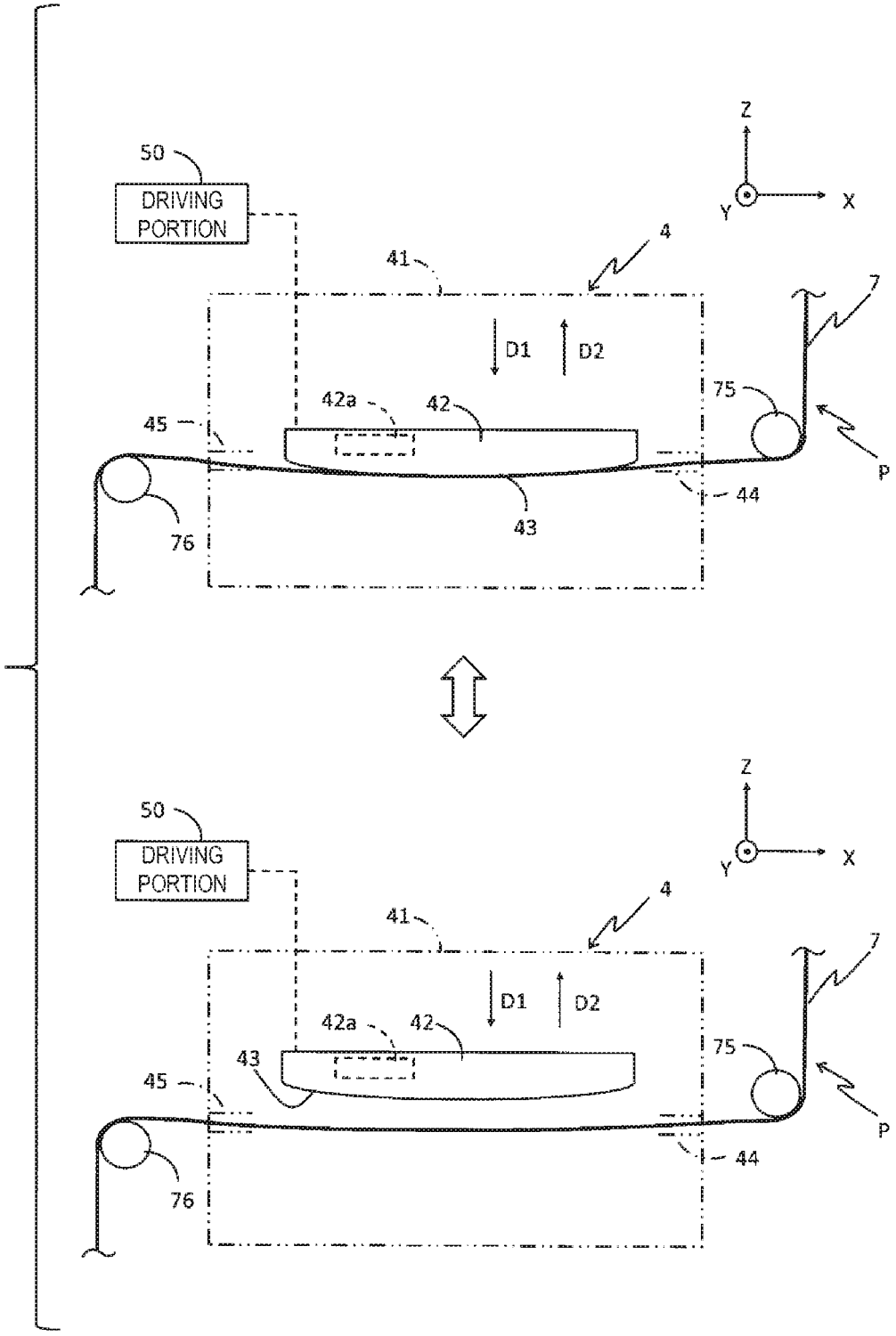
FIG. 2 is a diagram illustrating a drying portion or the like of a first example.

FIG. 2 illustrates the drying portion 4 and the like according to a first example included in the present embodiment. The drying portion 4 includes a housing 41 and a heating portion 42 housed in the housing 41. In FIG. 2, the housing 41 is illustrated simply by a two-dot chain line. The housing 41 has a receiving port 44 in an upstream facing surface and a delivery port 45 in a downstream facing surface. The receiving port 44 and the delivery port 45 are slit-shaped holes through which the printing medium 7 can pass. In other words, the printing medium 7 loaded into the housing 41 from the receiving port 44 in the course of being transported downstream by the transport portion, and is transported out of the housing 41 from the delivery port 45.

According to the example in FIGS. 1 and 2, of the surface of the printing medium 7, a printing surface on which printing is performed by receiving the discharge of the ink by the print heads 34 faces downward when passing through the housing 41 of the drying portion 4. In such a configuration, inside the heating portion 41, the heating portion 42 is disposed above a height at which the printing medium 7 passes through. In other words, the heating portion 42 is disposed in a position facing a back surface of the printing medium 7, which is on the opposite side from the printing surface.

A heat source 42*a* is provided inside the heating portion 42, for example, and the heating portion 42 is heated by the heat generated by the heat source 42*a*. The heat source 42*a* for the heating portion 42 performs a similar function to that of the heater 38 for the platen 30. However, for example, a configuration may be employed in which the heating portion 42 is not provided with the heat source 42*a*, an entire space inside the housing 41 is heated by a heat source (not illustrated), and the heating portion 42 made of metal disposed in this space is maintained at a predetermined temperature.

In the first example, the heating portion 42 can move in a first direction D1 approaching the back surface of the printing medium 7 inside the housing 41, and in a second direction D2 separating from the back surface. In the example illustrated in FIG. 2, the second direction D2 is the same upward direction as the Z direction, and the first direction D1 is the downward direction. However, the first direction D1 and the second direction D2 may be inclined with respect to the Z direction rather than parallel to the Z direction.

The movement of the heating portion 42 is realized by a driving portion 50. The driving portion 50 includes, for example, a motor, a gear train that transmits a driving force to the heating portion 42, and the like. In response to a driving force from the driving portion 50, the heating portion 42 is movable along a guide rail (not illustrated) that is parallel with the first direction D1 and the second direction D2. Operations of the driving portion 50 are controlled by the controller 10.

The upper section in FIG. 2 illustrates a case of a "first state" in which the heating portion 42 is in contact with the back surface of the printing medium 7, and the lower section in FIG. 2 illustrates a case of a "second state" in which the heating portion 42 is not in contact with the back surface of the printing medium 7.

In the present embodiment, the second state of the heating portion 42 refers to a state in which there is less contact with the back surface of the printing medium 7 than in the first state. Accordingly, the concept of the second state also includes a state in which a portion of the heating portion 42 is in contact with the back surface of the printing medium 7. As illustrated in the lower section in FIG. 2, a state in which the heating portion 42 and the printing medium 7 are completely separated is a type of the second state.

The heating portion 42 comes into contact with the back surface by a surface 43 facing the back surface of the printing medium 7 making contact. The surface 43 may be a flat surface, but in the example in FIG. 2, the surface 43 is a curved surface that is convex toward the back surface.

Figure 4:
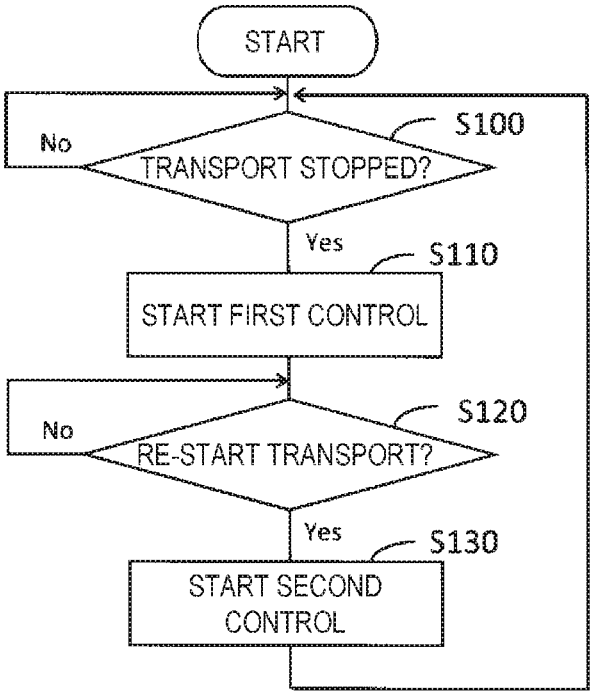
FIG. 4 is a flowchart illustrating state switching control.

FIG. 4 is a flowchart illustrating state switching control of the heating portion 42 executed by the controller 10. FIG. 4 corresponds to a control step for controlling the heating portion. Of course, in addition to the process illustrated in FIG. 4, the controller 10 executes multiple controls in parallel, such as the control of the intermittent transport by the transport portion, the control of print processing by the printing portion 3, and the like. Note that the process illustrated in FIG. 4 is started after the printing unit 31 has performed the printing of at least the first frame on the printing medium 7 transported by the transport roller 73.

With reference to FIG. 4, steps from step S100 are described in order. The controller 10 repeatedly determines whether the transport of the printing medium 7 by the transport portion has been stopped (step S100), and, when the transport has been stopped ("Yes" at step S100), the controller 10 proceeds to step S110.

At step S110, the controller 10 starts first control for causing the heating portion 42 to be in the first state in contact with the back surface of the printing medium 7. Specifically, as the first control, the controller 10 causes the driving portion 50 to move the heating portion 42 in the first direction D1 by operating the driving portion 50, and causes the heating portion 42 to press the back surface of the printing medium 7. Then, as the first control, the controller 10 causes the driving portion 50 to stop the movement of the heating portion 42 in the state in which the heating portion 42 is pressing the back surface of the printing medium 7.

As a result, as illustrated in the upper section in FIG. 2, the whole of the surface 43 or nearly the whole of the surface 43 of the heating portion 42 is in close contact with the back surface of the printing medium 7, that is, the first state is obtained. As a result of the heating portion 42 being in the first state, the degree of adhesion between the heating portion 42 and the printing medium 7 increases, and the heating of the printing medium 7 by the heating portion 42, that is, the drying of the printing medium 7, is efficiently performed. In addition, since the heating portion 42 and the back surface of the printing medium 7 are in surface contact, the temperature is uniformly transferred from the heating portion 42 to each position of the printing medium 7, and drying unevenness is also suppressed.

After starting the first control, the controller 10 repeatedly determines whether or not to re-start the transport of the printing medium 7 by the transport portion (step S120). In the intermittent transport of the printing medium 7, the length of the transport stop period of the transport is determined in advance as a predetermined time period. Thus, the controller 10 determines that the transport is to be re-started ("Yes" at step S120) immediately before a timing at which the predetermined time period elapses from the determination of "Yes" at step S100, such as a few seconds before the predetermined time period elapses, for example. Then the controller 10 advances to step S130. In other words, the controller 10 performs step S130 at a timing slightly earlier than when the transport of the printing medium 7 is actually re-started.

At step S130, the controller 10 starts second control for causing the heating portion 42 to be in the second state. Specifically, as the second control, by operating the drive portion 50, the controller 10 causes the driving portion 50 to move the heating portion 42 in the second direction D2 by operating the driving portion 50, and causes the heating portion 42 to separate from the back surface of the printing medium 7. Then, as the second control, the controller 10 causes the drive portion 50 to stop the movement of the heating portion 42 in a state in which the heating portion 42 is separated from the back surface of the printing medium 7.

As a result, as illustrated in the lower section in FIG. 2, the surface 43 of the heating portion 42 is separated from the back surface of the printing medium 7, that is, the second state is obtained. As a result of the heating portion 42 being in the second state, the heating portion 42 does not obstruct the progress of the printing medium 7, and the transport of the printing medium 7 is smoothly performed. After starting the second control, the controller 10 performs the determination at step S100.

In this way, since the first control is performed in a period from when the controller 10 determines "Yes" at step S100 to when the controller 10 determines "Yes" at step S120, the heating portion 42 is in the first state during the transport stop period of the transport of the printing medium 7. Further, since the second control is performed in a period from when the controller 10 determines "Yes" at step S120 to when the controller 10 determines "Yes" at step S100, the heating portion 42 is in the second state during a transport period in which the printing medium 7 is transported. In other words, the controller 10 alternately switches between the first control and the second control.

As illustrated in the lower section in FIG. 2, the printing medium 7 is likely to sag downward due to its own weight between the roller 75 and the roller 76. In view of the situation in which the printing medium 7 sags downward in this manner, the surface 43 of the heating portion 42 curves in a convex shape toward the printing medium 7. Therefore, when the heating portion 42 is moved in the first direction D1 and is pressed against the back surface of the printing medium 7, a gap does not easily occur between the surface 43 and the back surface of the printing medium 7, and the degree of adhesion between the heating portion 42 and printing medium 7 can be increased.

2-2. Second Example

Figure 3:
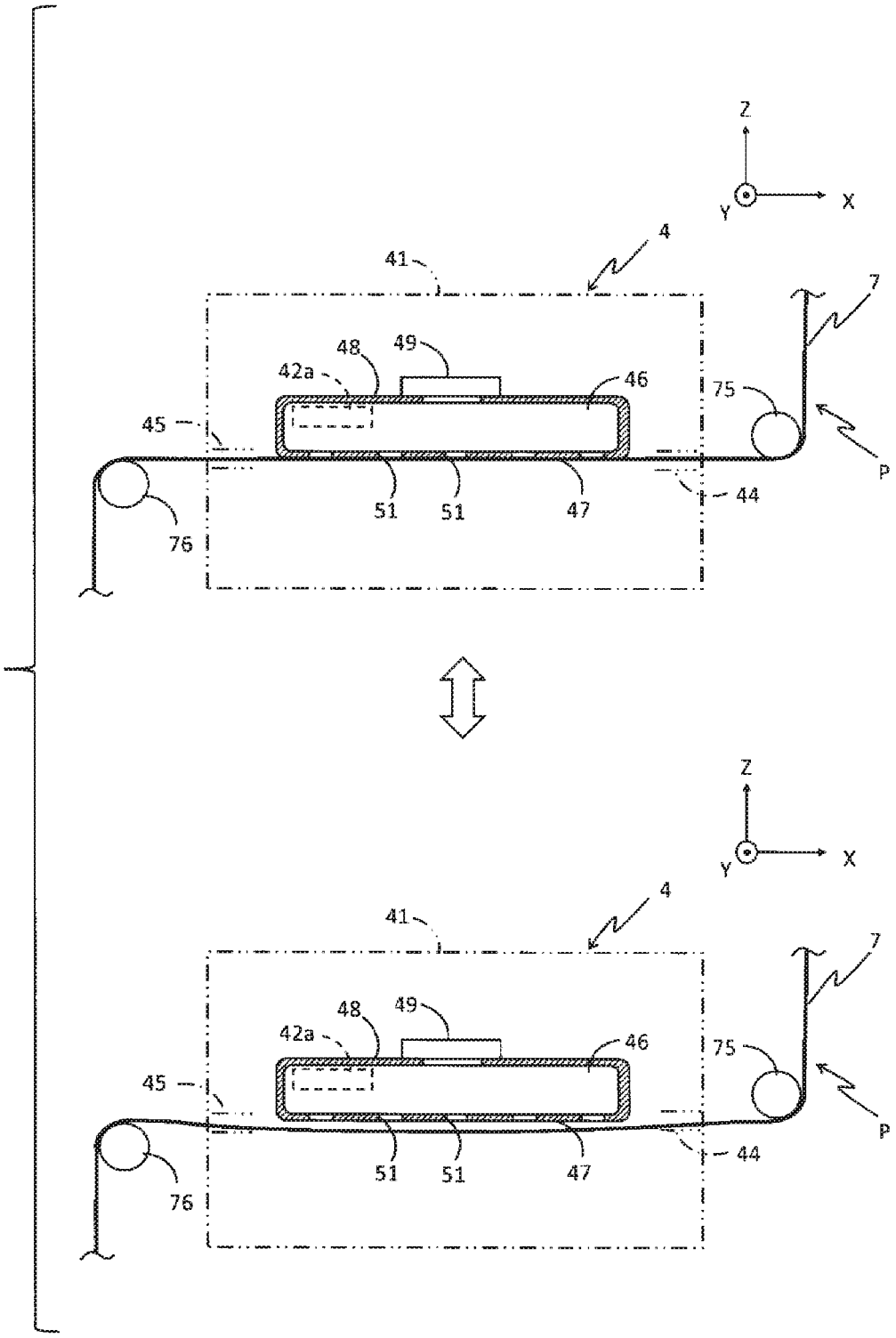
FIG. 3 is a diagram illustrating the drying portion or the like of a second example.

FIG. 3 illustrates the drying portion 4 and the like according to a second example included in the present embodiment. In FIG. 3, the same components as in FIG. 2 are assigned the same reference signs as in FIG. 2. With respect to the second example, a description of the same content as that of the first embodiment will be omitted as appropriate. The drying portion 4 includes a heating portion 46 in the housing 41. In the housing 41, the heating portion 46 is disposed in a position facing the back surface of the printing medium 7. In FIG. 3, the heating portion 46 is illustrated by a partial cross-sectional view.

Similar to the heating portion 42 of the first embodiment, the heat source 42*a* is provided inside the heating portion 46, for example, and the heating portion 46 is heated by the heat generated by the heat source 42*a*. The heating portion 46 includes a plurality of suction holes 51 capable of sucking air, in a surface 47 that faces the back surface of the printing medium 7. The suction holes 51 are communicated with an internal space of the heating portion 46. Further, in the heating portion 46, a suction portion 49 and the internal space of the heating portion 46 are communicated with each other in a surface 48 facing the surface 47. The suction portion 49 includes a fan (not illustrated), and a motor (not illustrated) for driving the fan, and is capable of performing air suction. The suction portion 49 may be understood to perform a similar function for the heating portion 46 as that of the suction portion 37 for the platen 30. The suction portion 49 is controlled by the controller 10.

The upper section of FIG. 3 illustrates a case in which the heating portion 46 is in the "first state" and the lower section in FIG. 3 illustrates a case in which the heating portion 46 is in the "second state". The heating portion 46 is in contact with the back surface of the printing medium 7 using the surface 47 facing the back surface. In the example in FIG. 3, the surface 47 is a flat surface, but the surface 47 may be a curved surface in a similar manner to the surface 43 of the first example.

State switching control of the heating portion 46 will be described with reference to the flowchart in FIG. 4, for the second example also. Each of the determinations at step S100 and step S120 is as described above in the first example. At step S110, the controller 10 starts the first control for causing the heating portion 46 to be in the first state in which the heating portion 46 is in contact with the back surface of the printing medium 7. Specifically, as the first control, the controller 10 operates the suction portion 49 and causes the suction portion 49 to perform the air suction. In this way, air outside the heating portion 46 is sucked through the suction holes 51, and the back surface of the printing medium 7 adheres to the surface 47 of the heating portion 46.

As a result, as illustrated in the upper section in FIG. 3, the whole of the surface 47 or nearly the whole of the surface 47 of the heating portion 46 is in close contact with the back surface of the printing medium 7, that is, the first state is obtained. As a result of the heating portion 46 being in the first state, the heating of the printing medium 7 by the heating portion 46, that is, the drying of the printing medium 7, is efficiently performed. In addition, since the heating portion 46 and the back surface of the printing medium 7 are in surface contact, the temperature is uniformly transferred to each position of the printing medium 7, and the drying unevenness is also suppressed.

At step S130, the controller 10 starts the second control for causing the heating portion 46 to be in the second state. Specifically, as the second control, the controller 10 stops the suction of the air by the suction portion 49. As a result, the suction of the air via the suction holes 51 stops, the degree of contact between the surface 47 of the heating portion 46 and the back surface of the printing medium 7 is reduced, and the heating portion 46 is in the second state. As a result of the heating portion 46 being in the second state, friction between the heating portion 46 and the printing medium 7 is eliminated, and the transport of the printing medium 7 is smoothly performed.

In the second example, as the second control, the controller 10 may not only stop the suction of the air, but may also discharge the air from the suction holes 51. It is assumed that the suction portion 49 is not only capable of sucking the air, but is also capable of blowing the air, for example, by switching a rotation direction of the fan. In other words, at step S130, the controller 10 may switch the operation of the suction portion 49 from the air suction to the air blowing. As a result, the air is discharged to the outside of the heating portion 46 via the suction holes 51, and the degree of contact between the surface 47 of the heating portion 46 and the back surface of the printing medium 7 is more reliably reduced, and the heating portion 46 is in the second state.

3. Summary

As described above, according to the present embodiment, the printing apparatus 100 includes the printing portion 3 that performs the printing on the printing medium 7 by discharging the ink onto the printing medium 7, the heating portion that heats the printed printing medium 7 downstream of the printing portion 3 in the transport of the printing medium 7, and the controller 10. The heating portion is disposed in a position facing the back surface, which is a surface of the printing medium 7 opposite to the printing surface on which the printing is performed. The controller 10 executes the first control causing the heating portion to be in the first state in which the heating portion is in contact with the back surface, during the transport stop period in which the transport of the printing medium 7 is stopped, and the second control causing the heating portion to be in a second state in which the degree of contact of the heating portion with the back surface is less than in the first state, during the transport period in which the transport of the printing medium 7 is performed.

According to the above-described configuration, by increasing the degree of adhesion between the heating portion and the back surface of the printing medium 7 during the transport stop period of the transport, the printing medium 7 can be dried efficiently and uniformly while eliminating unevenness. Further, the degree of contact between the heating portion and the back surface of the printing medium 7 is reduced in the transport period, and the smooth transport of the printing medium 7 can be achieved.

Further, according to the first embodiment, the heating portion 42 is movable in the first direction D1 approaching the back surface of the printing medium 7 and in the second direction D2 separating from the back surface. The controller 10 causes the heating portion 42 to be in the first state by moving the heating portion 42 in the first direction D1 and causing the heating portion 42 to press against the back surface, and causes the heating portion to be in the second state by moving the heating portion 42 in the second direction D2 and causing the heating portion 42 to separate from the back surface.

According to this configuration, the degree of adhesion between the heating portion 42 and the printing medium 7 during the transport stop period can be reliably improved, and the smooth transport of the printing medium 7 can be realized without the heating portion 42 coming into contact with the back surface of the printing medium 7 during the transport period.

In addition, the surface 43 of the heating portion 42 that faces the back surface of the printing medium 7 may be the curved surface that is convex toward the back surface.

According to this configuration, even in a situation where the printing medium 7 may sag under its own weight, it is possible to increase the degree of adhesion between the heating portion 42 and the back surface of the printing medium 7 during the transport stop period.

In addition, according to the second example, the heating portion 46 includes the plurality of suction holes 51 capable of sucking the air through the surface 47 facing the back surface of the printing medium 7, and the controller 10 causes the heating portion 46 to be in the first state by performing the suction of the air via the suction holes 51, and causes the heating portion 46 to be in the second state by stopping the suction.

According to this configuration, the degree of adhesion between the heating portion 46 and the back surface of the printing medium 7 can be reliably increased during the transport stop period, and the degree of contact between the heating portion 46 and the back surface of the printing medium 7 is reduced in the transport period, so the smooth transport of the printing medium 7 can be achieved.

Further, the controller 10 may stop the suction, and at the same time, may discharge the air from the suction holes 51, thereby causing the heating portion 46 to be in the second state.

According to this configuration, the friction between the heating portion 46 and the back surface of the printing medium 7 can be made substantially zero in the transport period.

Further, the present embodiment discloses a printing method. In other words, the printing method includes a transport step for executing intermittent transport, in which transport and step of the transport of the printing medium 7 are repeated, a printing step for performing printing on the printing medium 7 by discharging ink onto the printing medium 7 by using the printing portion 3 during a stop period in which the transport of the printing medium 7 is stopped, a heating step for heating, downstream of the printing portion 3 in the transport of the printing medium 7, the printed printing medium 7 during the transport stop period by using a heating portion disposed in a position facing a back surface, which is an opposite surface of the printing medium 7 from a printing surface, on which the printing is performed, and a control step for controlling the heating portion. In the control step, the first control is executed to put the heating portion in the first state in which the heating portion is in contact with the back surface, during the transport stop period, and the second control is executed to put the heating portion in the second state in which the heating portion contacts the back surface at a lower degree than in the first state during the transport period in which the transport of the printing medium 7 is performed.

Further, the program executed by the processor of the controller 10 to implement the present embodiment can also be considered to be the disclosure.

What is claimed is:

1. A printing apparatus comprising:

a printing portion configured to perform printing on a printing medium by discharging ink onto the printing medium;

a heating portion configured to heat the printed printing medium, which is performed downstream of the printing portion in transport of the printing medium; and a controller, wherein the heating portion is disposed in a position facing a back surface, which is an opposite surface of the printing medium from a printing surface, on which the printing is performed, and the controller executes first control for putting the heating portion in a first state in which the heating portion is in contact with the back surface during a stop period, in which transport of the printing medium is stopped, and executes second control for putting the heating portion in a second state in which the heating portion contacts the back surface at a lower degree than in the first state during a transport period, in which the transport of the printing medium is performed.

2. The printing apparatus according to claim 1, wherein the heating portion is movable in a first direction of approaching the back surface and in a second direction of separating away from the back surface, and the controller puts the heating portion in the first state by moving the heating portion in the first direction thereby causing the heating portion to press against the back surface, and puts the heating portion in the second state by moving the heating portion in the second direction thereby causing the heating portion to separate away from the back surface.

3. The printing apparatus according to claim 2, wherein a surface, which faces the back surface of the heating portion, has a curved shape that is convex toward the back surface.

4. The printing apparatus according to claim 1, wherein the heating portion has a surface that faces the back surface and includes a plurality of suction holes configured to suck air, and the controller puts the heating portion in the first state by performing suction of air via the suction holes, and puts the heating portion in the second state by stopping the suction.

5. The printing apparatus according to claim 4, wherein the controller puts the heating portion in the second state by stopping the suction and also discharging air from the suction holes.

* * * * *